United States Patent [19]

Wengel

[11] 4,005,843

[45] Feb. 1, 1977

[54] HANGING DISPLAY ROTATOR

[75] Inventor: Sheldon M. Wengel, Reedsburg, Wis.

[73] Assignee: Gerber Products Company, Fremont, Mich.

[22] Filed: Oct. 31, 1975

[21] Appl. No.: 627,815

[52] U.S. Cl. ..... 248/220.2; 40/33; 47/39; 185/40 B; 211/1.5; 310/68 B

[51] Int. Cl.[2] ..... G09F 11/00

[58] Field of Search ..... 47/35, 39; 40/53.2, 40/33, 125, 139, 128, 106, 104, 84, 68, 49, 39, 53; 185/40, 43, 44; 248/425, 130, 358, 45, 317, 318, 323, 343, 223; 211/111, 1.5; 200/60; 240/10.66; 222/142–142.9; 310/68 B, 68 E, 71; 318/120

[56] References Cited

UNITED STATES PATENTS

| | | | |
|---|---|---|---|
| 2,137,230 | 11/1938 | Arden | 240/10.66 |
| 3,176,092 | 3/1965 | Lukasek | 200/60 |
| 3,375,381 | 3/1968 | Tavel | 200/60 X |
| 3,533,489 | 10/1970 | Dinnerstein | 40/53 R X |

*Primary Examiner*—Edgar S. Burr
*Assistant Examiner*—James R. Feyrer
*Attorney, Agent, or Firm*—Townsend and Townsend

[57] ABSTRACT

A rotator for a hanging display such as a mobile, hanging plant or the like having a self-contained power supply. The apparatus comprises a cylinder for containing flashlight batteries adjacent one another and for containing motor means to drive a geared shaft by which a display is suspended and rotated. Off-on operation and series battery interconnection are effected by the positioning of a rotatable, electrically conductive circular top plate confronting the ends of the batteries. An opening in the rotatable plate is provided for replacement of the batteries. A tab on the top plate permits the plate to be rotated and to be suspended.

4 Claims, 3 Drawing Figures

FIG _ 1
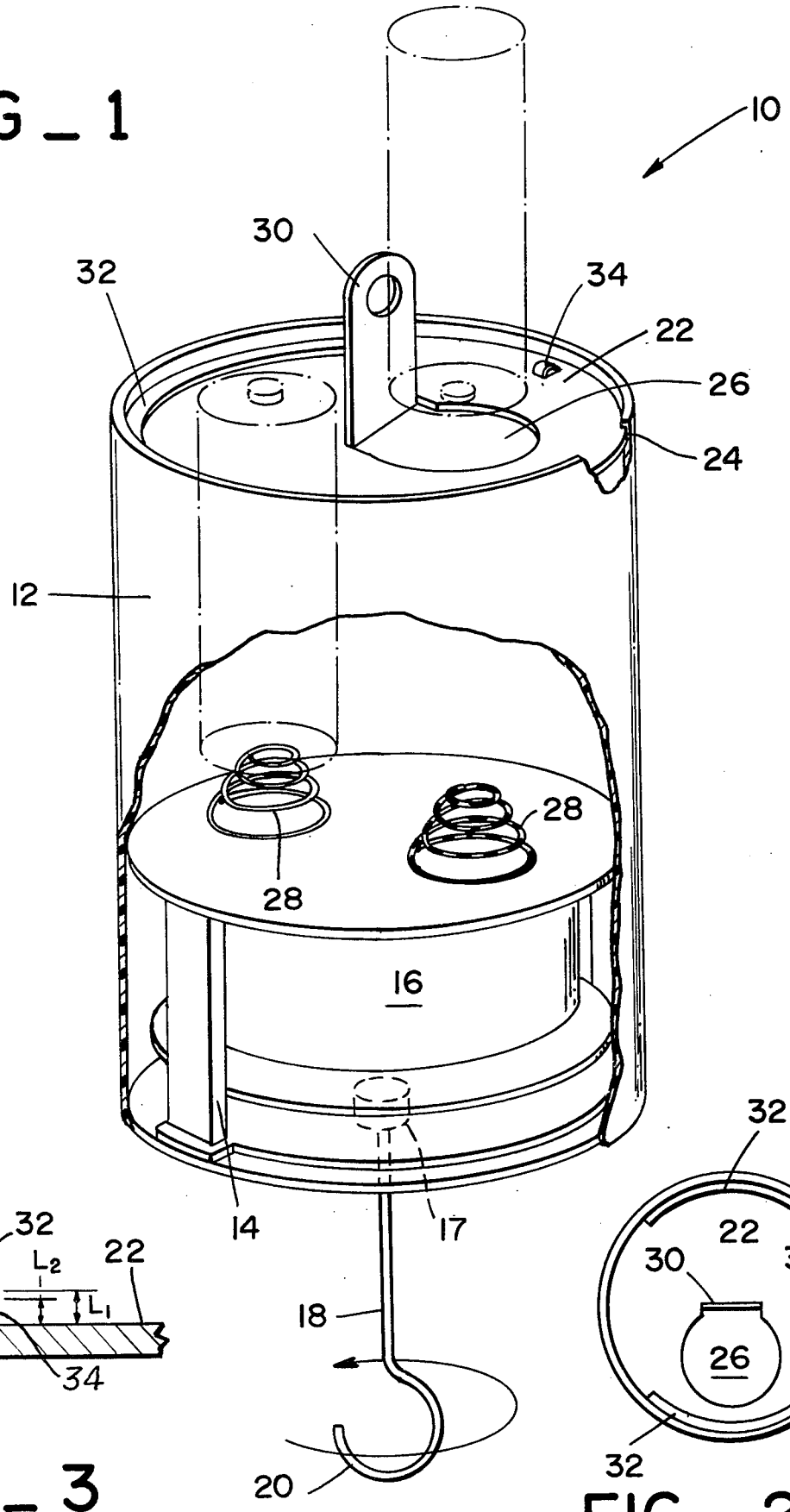
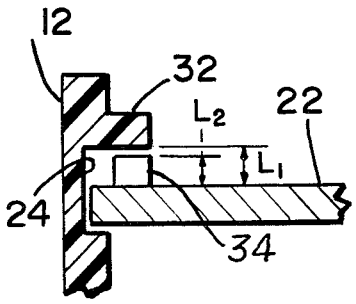
FIG _ 3
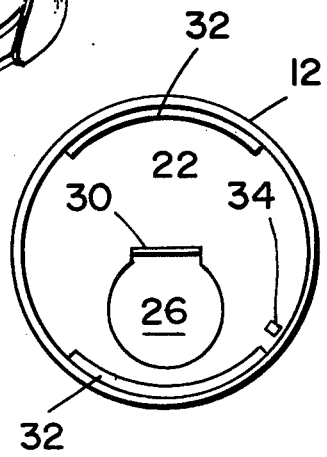
FIG _ 2

HANGING DISPLAY ROTATOR

BACKGROUND OF THE INVENTION

Field of the Invention

This invention relates to means for suspending and rotating hanging displays such as terrariums, potted plants, and advertising displays.

The popularity of hanging terrariums and potted plants has created an interest in providing a simple, inexpensive and reliable apparatus to present a pleasing display and to promote the symmetrical growth of the plants. In particular, it has been found that unless a light-seeking house-grown potted plant is rotated its branches and leaves tend to grow towards the source of light, such as a nearby window, thereby producing unsymmetrical plant growth which is generally considered undesirable.

In the field of commercial advertising, for example, it has been found that moving displays attract attention and enhance commercial promotion.

A reliable hanging rotator may find a variety of applications. For example, such a rotator could be used to suspend a mobile or other hanging art work.

SUMMARY OF THE INVENTION

According to the invention a rotator is provided for a hanging display, such as a mobile, hanging plant or the like, having a self-contained power supply. The apparatus comprises a cylinder for containing flashlight batteries adjacent to one another and for containing motor means to drive a geared shaft by which a display is suspended and rotated. An off-on operation and series battery interconnection is effected by the positioning of the rotatable, electrically-conductive circular top plate confronting the ends of the batteries. An opening in the rotatable plate is provided for replacement of the batteries, a tab on the top plate permits the top plates to be rotated and to be suspended.

The principle object of the present invention is to provide simple, inexpensive and reliable means for rotating a hanging display or the like which has an independent power supply.

A principle feature of the invention is the circular top plate which serves as an off-on switch, battery interconnection, access opening to the batteries and means for suspending the apparatus.

BRIEF DESCRIPTION OF THE DRAWINGS

Further objects and features of the invention will be evident upon examination of a specific embodiment of the invention with reference to the accompanying figures, in which:

FIG. 1 is a cutaway perspective view of a preferred embodiment of the invention;

FIG. 2 is a perspective view of the top plate according to the inventions; and

FIG. 3 is a cross-sectional view of a detail of a rim according to the invention.

DETAILED DESCRIPTION OF THE INVENTION

Referring to FIG. 1, a rotator, referred to generally as 10, is shown comprising a cylindrical body 12, having a motor mount 14, to which is attached a small highly efficient DC gear motor 16. The gear motor 16 drives a shaft 18 axially extending from the rotator 10. The shaft 18 includes a hook at the end thereof for the attachment of a hanging display (not shown).

The cylindrical body 12 forms a cavity for the containment of flashlight batteries adjacent one another. A top plate 22 is rotatably mounted in a track formed by a rim slot 24 inside the cylindrical body 12 (FIG. 3). Top plate 22, which has an electrically-conductive inner surface is disposed to confront the ends of the batteries within the cylindrical body 12, thereby to establish an electrical connection. The top plate 22, as shown also in FIG. 2, includes an opening 26 of sufficient size to insert and to remove batteries. Springs 28 attached to the motor mount 14 serve as the electrical terminals for the motor 16. The springs 28 provide pressure to insure adequate contact between the batteries and the top plate 22. The springs 28 are also operative to cause batteries to pop up when aligned with the opening 26, thereby to provide for easy removal.

The shaft 18 may be subjected to substantial axial loads. In order to prevent excessive wear to the geared motor 16, a gear train (not shown) is coupled through a ball bearing type suspension 17 (shown in phantom) to the shaft 18. The suspension is provided in a manner to relieve the gear train of motor 16 of excessive axial loading which may cause damage.

Referring to FIG. 2 in conjunction with FIG. 1, there is shown a suspension tab 30 disposed axially with the cylindrical body 12, i.e., in the center of the top plate 22. The tab 30 is of sufficient strength to permit the rotation of the top plate 22 upon application of a torque. The cylindrical body 12 further includes a partial flange 32 along the rim thereof adjacent the top plate. A stop tab or ridge 34, adjacent the rim of the top plate 22, is provided to prevent the suspended unit 10 from complete rotation with respect to the top plate 22 upon application of torque to tab 30. Tab 34 may be located on top plate 22 so as to encounter flange 32 upon a one-quarter turn rotation.

In this orientation the flange 32 and stop tab 34 may be disposed to limit rotation in a first direction at a position where the batteries are coupled to the motor 16 to turn it on. It will follow that a quarter turn in the opposite direction will turn off the motor since the ends of one of the batteries will confront the opening 26. Appropriate marking may be provided to indicate preferred orientation of the batteries for proper polarity. Marking may be by means of a symbol, notation, color coding of the springs or the like or by construction of the terminals to accept connection in only one orientation.

In one selected orientation, the battery polarity will cause motor rotation in a direction to cause automatic shut-off by rotation of the top plate 22 upon application of excessive or unwanted torque during operation of gear motors 16 resulting from a torque applied to hook 20. This feature may be utilized to prevent excessive motor load and possible damage to the apparatus when, for example, the objects suspended from hook 20 become caught on an external fixed object.

Referring to FIG. 3, a further feature of the invention is illustrated. Slot 24 is of sufficient axial width ($L_1$) with respect to body 12 to permit axial displacement of top plate 22 in excess of the height of tab 34 ($L_2$). This feature permits full circle rotation of top plate 22 without hindrance of stop tab 34 if top plate 22 is depressed away from the flange 32. Full circle rotation provides for access to both enclosed batteries and for on and off operation of the motor.

In operation the hanging rotator is intended not only to provide a hanging plant or the like with 360° exposure to a light source, it is also intended to attract attention thereto through its movement. Therefore, a typical rotation rate for a plant, might be ¼ rpm and a typical rotation rate of an inanimate object, such as a mobile, might be 3 rpm, depending upon the selection of motor gearing.

The invention has been described with respect to specific embodiments. Other embodiments incorporating essential features of the invention will be obvious to one of ordinary skill in the art. It is not intended that the invention be limited except as indicated by the appended claims.

What is claimed is:

1. A rotator for a hanging display having a self-contained power supply comprising:

a circular cylindrical body enclosing motor means having a shaft extending therefrom in axial orientation to said body, said shaft having hook means for hanging an object therefrom, said motor means being operative to rotate said shaft;

slot means defining an inwardly facing annulus along the inner wall of said body adjacent the end of said body opposite said motor means;

a rotatable, electrically conductive circular top plate with a rim slidably within said slot means, said top plate, cylindrical body and motor means comprising a battery chamber for enclosing batteries sidewise adjacent one another;

said top plate including an opening therein for the insertion or removal of batteries and further being operative to rotate with respect of said cylinder body to effect series electrical connection between sidewise adjacent batteries confronting said top plate actuating said motor means and to permit insertion and removal of batteries; and electrode spring means operative to establish electrical connection between batteries and terminals of said motor means for urging batteries into electrical contact with said top plate.

2. A rotator for a hanging display according to claim 1, further including means for limiting the rotational travel of said top plate to a first location turning said motor means on and to a second location turning said motor means off.

3. A rotator for a hanging display according to claim 2, wherein said cylindrical body includes at least one flange protruding inwardly adjacent said slot means and wherein said top plate comprises a switch defined by a metal disc having suspension means at the center thereof and a stop tab adjacent to the rim of said disc, said stop tab being operative to limit the rotational travel of said disc to one quarter turn when said rotator is suspended by said top plate and said stop tab is disposed to impinge upon said body flange for defining the on position and off position of said disc such that application of excessive torque in a selected rotational direction causes automatic shut-off of said motor means.

4. A rotator for a hanging display having a self-contained power supply comprising:

a cylindrical body enclosing motor means having a shaft extending therefrom in axial orientation to said body, said shaft having hook means for hanging an object therefrom, said motor means being operative to rotate said shaft;

slot means defining an inwardly facing annulus along the inner wall of said body adjacent the end of said body opposite said motor means;

at least one flange protruding inwardly adjacent said slot means;

a rotatable, electrically conductive circular top plate with a rim slidably disposed within said slot means;

a stop tab disposed on the normally top side of said top plate adjacent the rim of said top plate;

said slot means being of axial dimension with respect to said body greater than the height of said stop tabs;

said stop tab being disposed to impinge upon said at least one flange when said rotator is suspended by said top plate;

said stop tab being further disposed to avoid said at least one flange when said top plate is axially depressed within said slot means, such that said stop tab and said at least one flange are cooperative to limit the rotational travel of said top plate to define a motor on position and a motor off position when said rotator is suspended, and to allow axial displacement of said top plate for permitting full circle rotation although hindrance of said stop tab and thereby insertion and removal of batteries when said top plate is depressed.

* * * * *